US007335065B1

(12) United States Patent
Chen

(10) Patent No.: US 7,335,065 B1
(45) Date of Patent: Feb. 26, 2008

(54) CABLE ADAPTOR

(75) Inventor: Hsiang-Feng Chen, Yungkang (TW)

(73) Assignee: Aimmet Industrial Co., Ltd., Tainan (TW)

( * ) Notice: Subject to any disclaimer, the term of this patent is extended or adjusted under 35 U.S.C. 154(b) by 0 days.

(21) Appl. No.: 11/552,108

(22) Filed: Oct. 23, 2006

(51) Int. Cl.
*H01R 25/00* (2006.01)

(52) U.S. Cl. ..... 439/654

(58) Field of Classification Search ..... 439/654, 439/902, 638, 578, 855
See application file for complete search history.

(56) References Cited

U.S. PATENT DOCUMENTS 4,640,567 A * 2/1987 Lundergan et al. ..... 439/271
5,171,161 A * 12/1992 Kachlic ..... 439/352
5,580,268 A * 12/1996 Miyazawa ..... 439/352
5,620,339 A * 4/1997 Gray et al. ..... 439/578
6,206,712 B1 * 3/2001 Norizuki et al. ..... 439/247
6,450,829 B1 * 9/2002 Weisz-Margulescu ..... 439/352
7,074,066 B2 * 7/2006 Pepe ..... 439/321
2004/0053531 A1 * 3/2004 Annequin ..... 439/578
2006/0258209 A1 * 11/2006 Hall ..... 439/578

FOREIGN PATENT DOCUMENTS

TW 529813 4/2003
TW 536036 6/2003

* cited by examiner

*Primary Examiner*—Chandrika Prasad
(74) *Attorney, Agent, or Firm*—J.C. Patents

(57) ABSTRACT

A cable adaptor includes a female connector, a male connector and a terminal base. The female connector has a male terminal hole for a male terminal of the terminal base to fit so that another exterior connector may fit therein and easily pulled off. The male connector is combined with the male terminal of the terminal base, having plural elastic petals fitted integrally around the terminal hole so that another exterior connector may fit therein and elastically held. The terminal base has a male terminal at one end and a female terminal at the other end, a male terminal at two ends respectively, or a female terminal at two ends respectively. The cable adaptor has a FARKA SMB (F.S.) male connector and a F.S. female connector, two F.S. male connectors or two F.S. female connectors, or a F.S. male or female connector and a SMB male or female conductor.

12 Claims, 12 Drawing Sheets

CABLE ADAPTOR

BACKGROUND OF THE INVENTION

1. Field of the Invention

This invention relates to a cable adaptor, particularly to one having a connector base with its opposite ends respectively provided with (1) a FAKRA SMB male and a FAKRA SMB female connector, (2) a FAKRA SMB male and a FAKRA SMB male connector, (3) a FAKRA SMB female and a FAKRA SMB female connector, (4) a FAKRA SMB male connector and an SMB male connector. (5) A FAKRA SMB male connector and an SMB female connector, or (6) a FAKRA SMB female connector and an SMB female connector, for connecting various kinds of exterior connectors, simple in structure and convenient in use.

2. Description of the Prior Art

A first conventional cable adaptor disclosed in a Taiwan patent No. 536036, titled "BNC CONNECTOR", has two tubes respectively provided inside with two insulators and two signal terminals secured with a fixing base. However, this kind of cable connector can only be used for connecting a single connector but cannot be used for connecting different exterior connectors at the same time. A second conventional cable adaptor disclosed in a Taiwan patent No. 529813, titled "COAXIAL CONNECTOR" has the same drawback as that of the first conventional cable connector.

SUMMARY OF THE INVENTION

The objective of the invention is to offer a cable adaptor having a connector base with two opposite ends respectively provided with a FAKRA SMB male connector and a FARKA SMB female connector, a FARKA SMB male connector and a FARKA SMB male connector, a FAKRA SMB female and a FARKA female connector, a FARKA SMB male connector and an SMB male connector, a FARKA SMB male and an SMB female connector, or a FARKA SMB female connector and an SMB female connector, making up a cable adaptor in the invention to connect various exterior cable connectors.

The cable adaptor of this invention has the following features:

1. The cable adaptor of this invention has a connector base with two opposite ends variously provided with a FAKRA SMB male connector and a FARKA SMB a female connector or with an SMB male connector or an SMB female connector in various ways.

2. The cable adaptor of this invention is provided with a FAKRA SMB male and/or female connector, or a FAKRA SMB male or a FARKA SMB female connector and an SMB male or female connector, for connecting various kinds of exterior cable connectors.

3. The FAKRA SMB male or the female connector or the SMB male or female connector combined with one end of the connector base can be freely turned for an angle, convenient for connecting exterior connectors.

BRIEF DESCRIPTION OF DRAWINGS

This invention will be better understood by referring to the accompanying drawings, wherein.

DETAILED DESCRIPTION OF THE PREFERRED EMBODIMENT

A first preferred embodiment of a cable adaptor in the present invention, as shown in FIGS. 1-6, includes a FAKRA SMB female connector 1, a terminal base 2 and a FAKRA SMB male connector 3 combined together.

Figure 3:
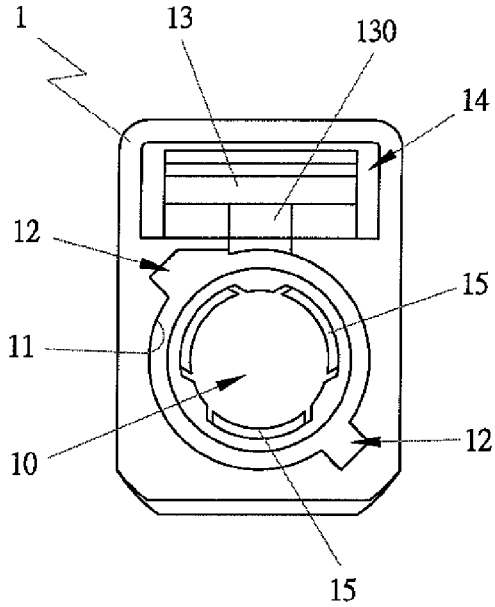
FIG. 3 is a front view of the first preferred embodiment of a female connector in the present invention.
Figure 7:
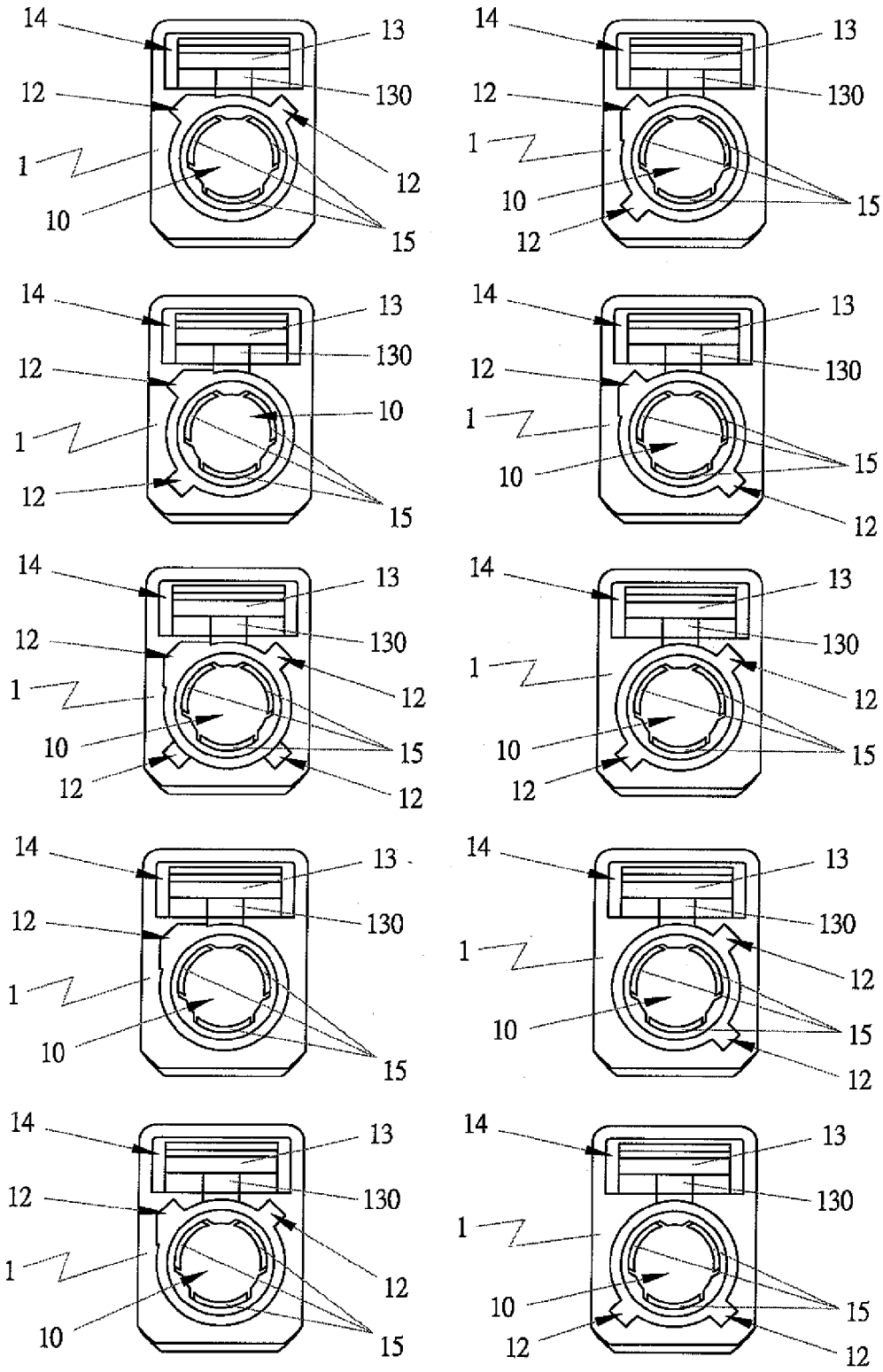
FIG. 7 is front views of the female connectors with different specifications in the present invention.

The FARKA SMB (F.S.) female connector 1 made integral of plastic is formed with a terminal-base hole 10 for receiving a female terminal 20 of the terminal base 2 therein. The terminal-base hole 10 has its front circumference formed with a comparatively large inner diameter and cut with correction notches 12 for facilitating connecting and correcting the position of an exterior connector, as shown in FIG. 3. The correction notches 12 of the F.S, female connector 1 can be changed according to different specifications of the female connector 1, such as ten specifications of the F.S. female connector 1 shown in FIG. 7 and others. Further the F.S. female connector 1 is provided with an engage member 13 received in an engage member groove 14 extending backward to be combined with the F.S. female connector 1. The engage member 13 has its rear end formed with a connecting rib 130 and a press member 131. When the press member 131 at the rear end of the engage member 13 is pressed downward, the front end of the engage member 13 will be pushed upward so that an exterior connector can conveniently be inserted in or pulled out of the terminal-base hole 10. The terminal-base hole 10 of the F.S. female connector 1 has its rear end disposed with a plurality of elastic petals 15 spaced apart so that the terminal base 2 can be easily and firmly combined with the terminal-base hole 10 of the F.S. female connector 1. The petals 15 have their inner walls formed with slanting surfaces 150, vertical fitting surfaces 151 and annular surfaces 152 for matching with the shapes of the terminal base 2.

Figure 6:
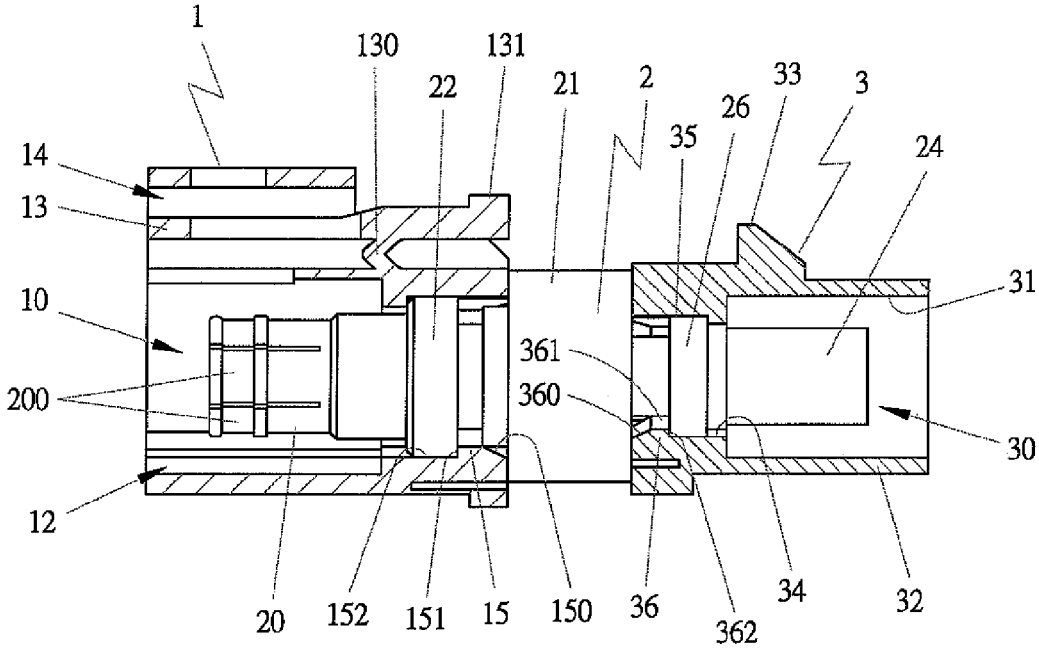
FIG. 6 is a side cross-sectional view of the line A-A in FIG. 5.
Figure 9:
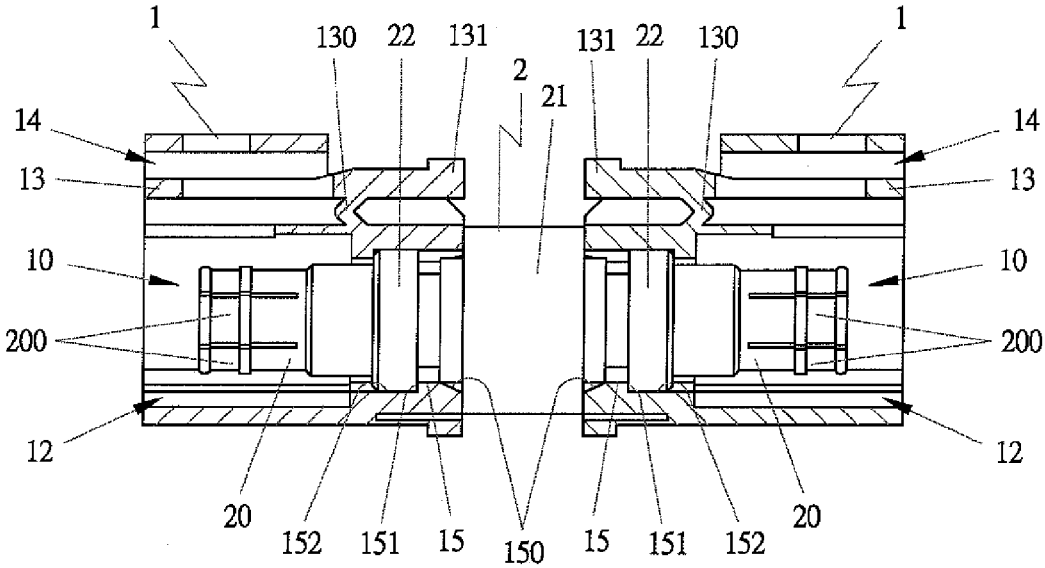
FIG. 9 is a side cross-sectional view of a second preferred embodiment of a cable adaptor in the present invention.
Figure 10:
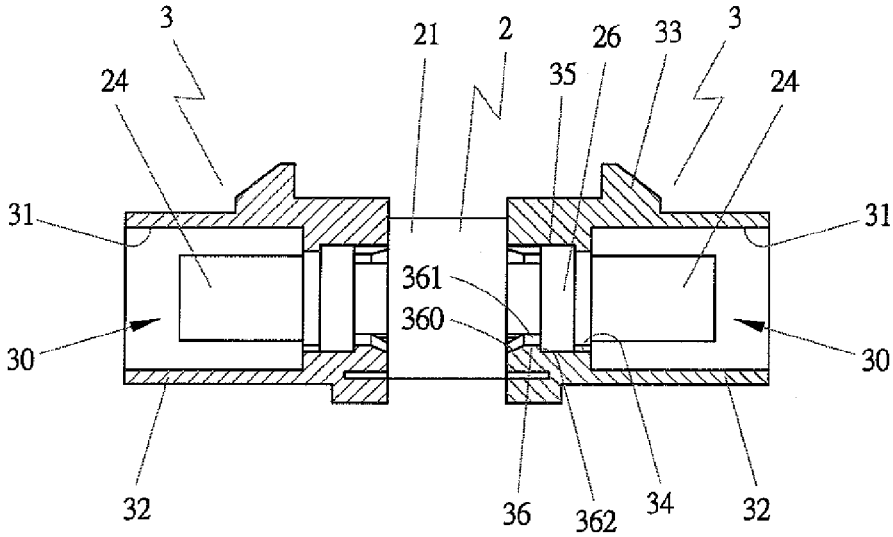
FIG. 10 is a side cross-sectional view of a third preferred embodiment of a cable adaptor in the present invention.
Figure 11:
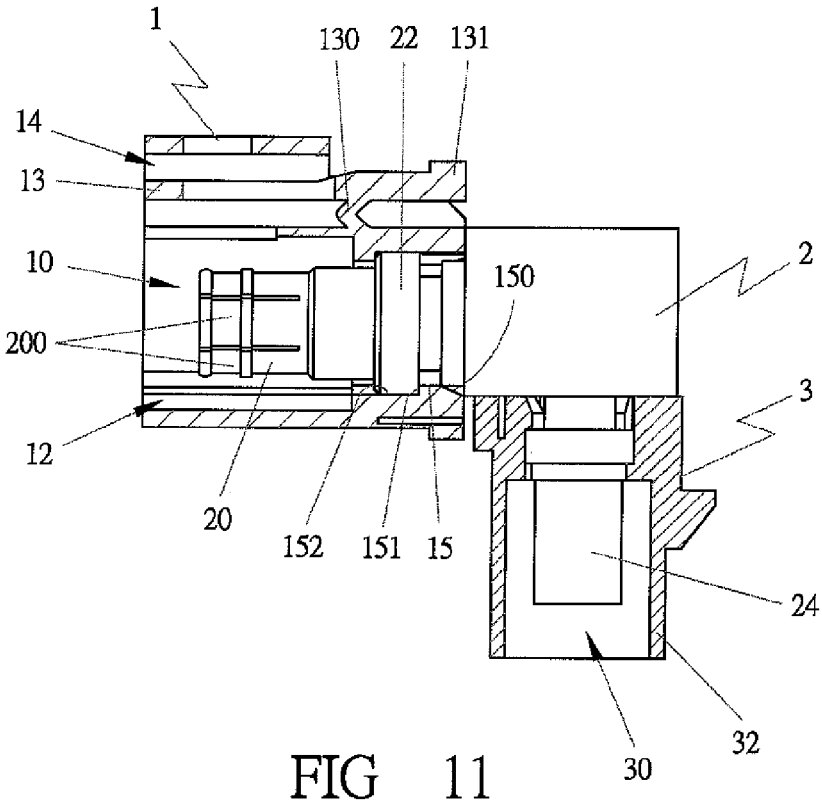
FIG. 11 is a side cross-sectional view of a fourth preferred embodiment of a cable adaptor in the present invention.
Figure 12:
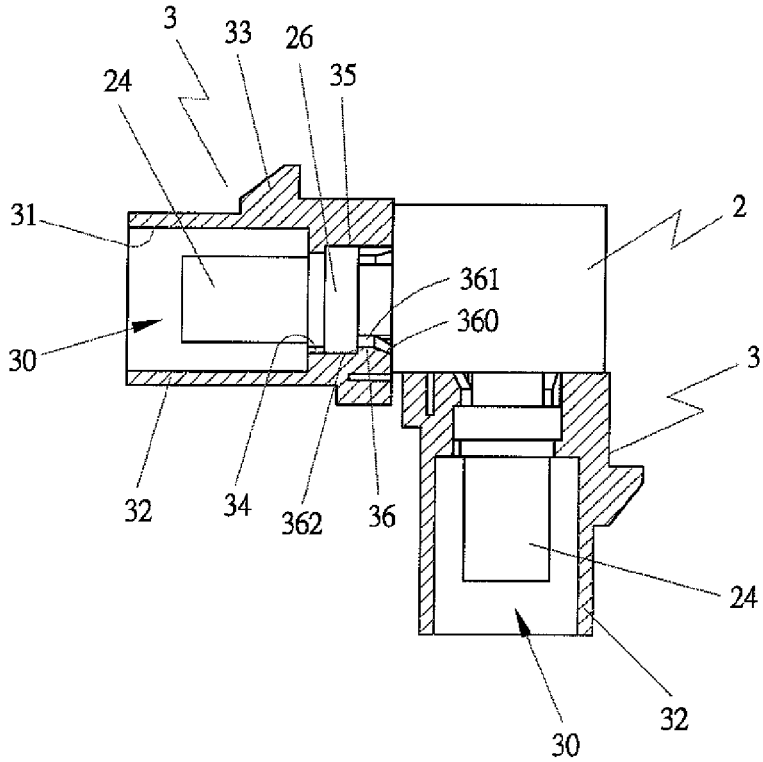
FIG. 12 is a side cross-sectional view of a fifth preferred embodiment of a cable adaptor in the present invention.
Figure 13:
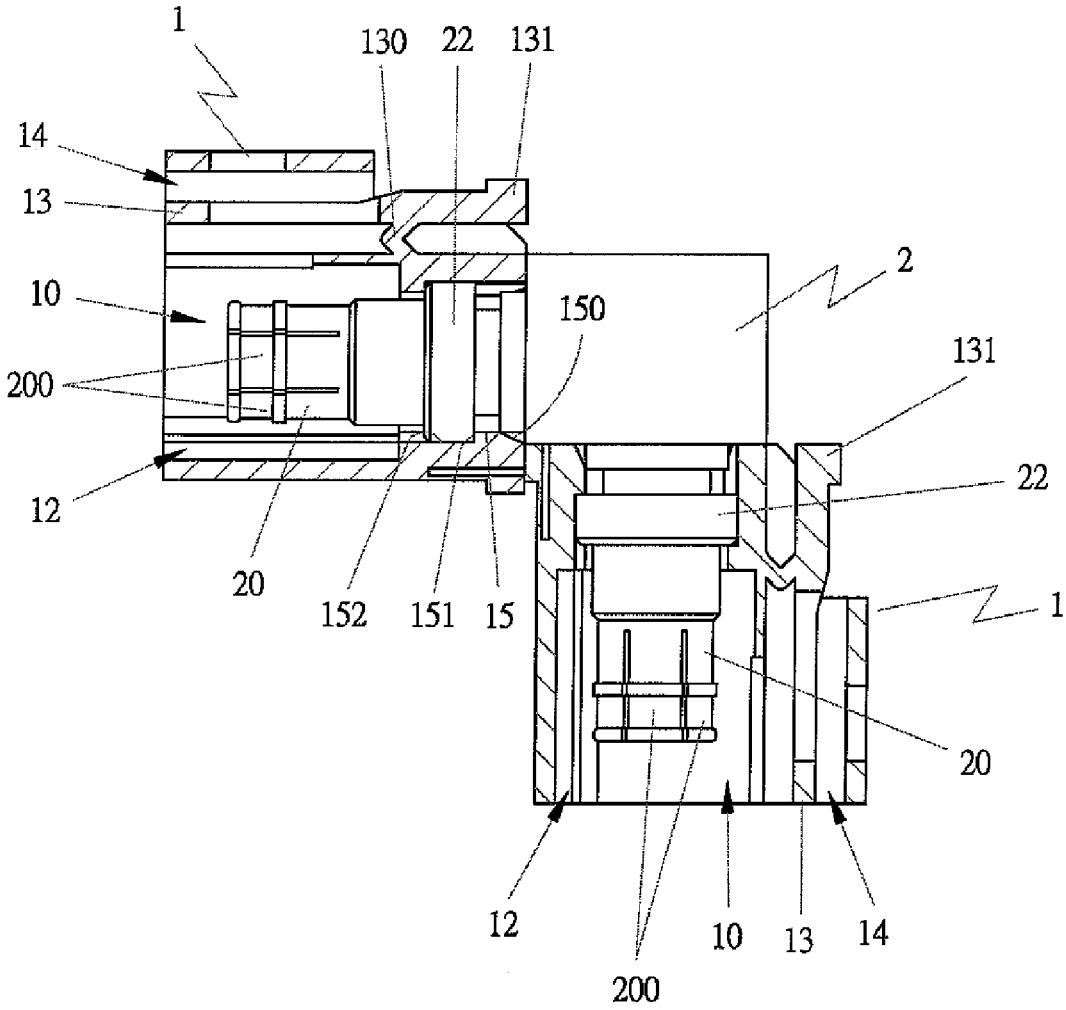
FIG. 13 is a side cross-sectional view of a sixth preferred embodiment of a cable adaptor in the present invention.

The terminal base 2 has its opposite ends respectively provided with a female terminal 20 and an male terminal 24, as shown in FIGS. 6 and 11, or both respectively provided with a female terminal 20 as shown in FIGS. 9 and 13, or both provided with a male terminal 24, as shown in FIGS. 10 and 12. In addition, the two terminals at the opposite ends of the terminal base 2 can be positioned in alignment, as shown in FIGS. 6, 9 and 10, or disposed at a proper angle, such as an angle of 90 degrees or 135 degrees or the like according to practical needs, as shown in FIGS. 11-13. The terminal base 2 has its female terminal 20 formed with a plurality of arc-shaped petals 200 spaced apart for facilitating combining an exterior connector with the terminal base 2. The terminal base 2 further has its intermediate portion formed with a large-diametric annular projection 21 and a small-diametric annular projection 22 respectively to be combined with the corresponding inner wall of the terminal base hole 10 of the F.S. female conductor 1 for firmly combining the terminal base 2 and the F.S. female connector 1 together. The male terminal 24 of the terminal base 2 has its interior fitted with a Teflon insulating bushing 25 and has its inner end fixed with a small-diametric annular projection 26. Thus, the small-diametric annular projection 26 and the large-diametric annular projection 21 of the terminal base 2 can be respectively fitted with the small-diametric annular circumference 34 and the medium-diametric annular circumference 35 of the terminal base hole 30 of the male connector 3 for combining the terminal base 2 and the F.S. male connector 3 together.

Figure 4:
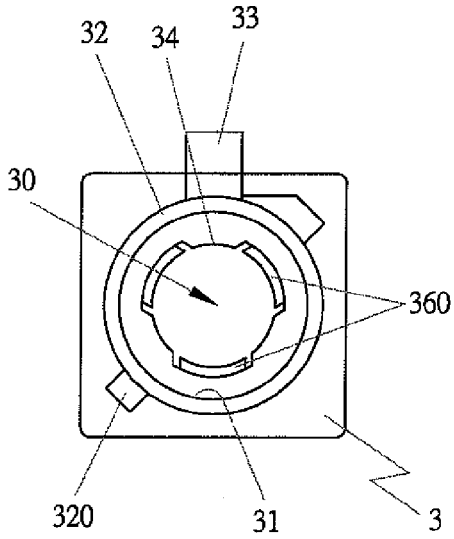
FIG. 4 is a front view of the first preferred embodiment of a male connector in the present invention.
Figure 5:
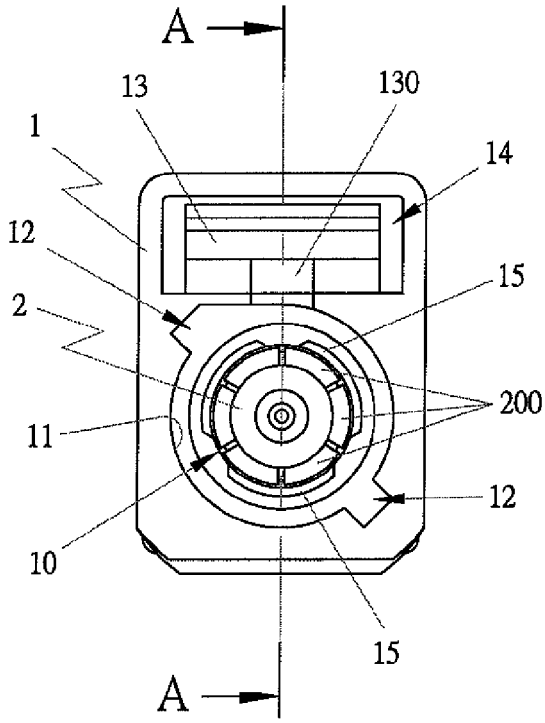
FIG. 5 is a front view of the first preferred embodiment of the cable adaptor in the present invention.
Figure 8:
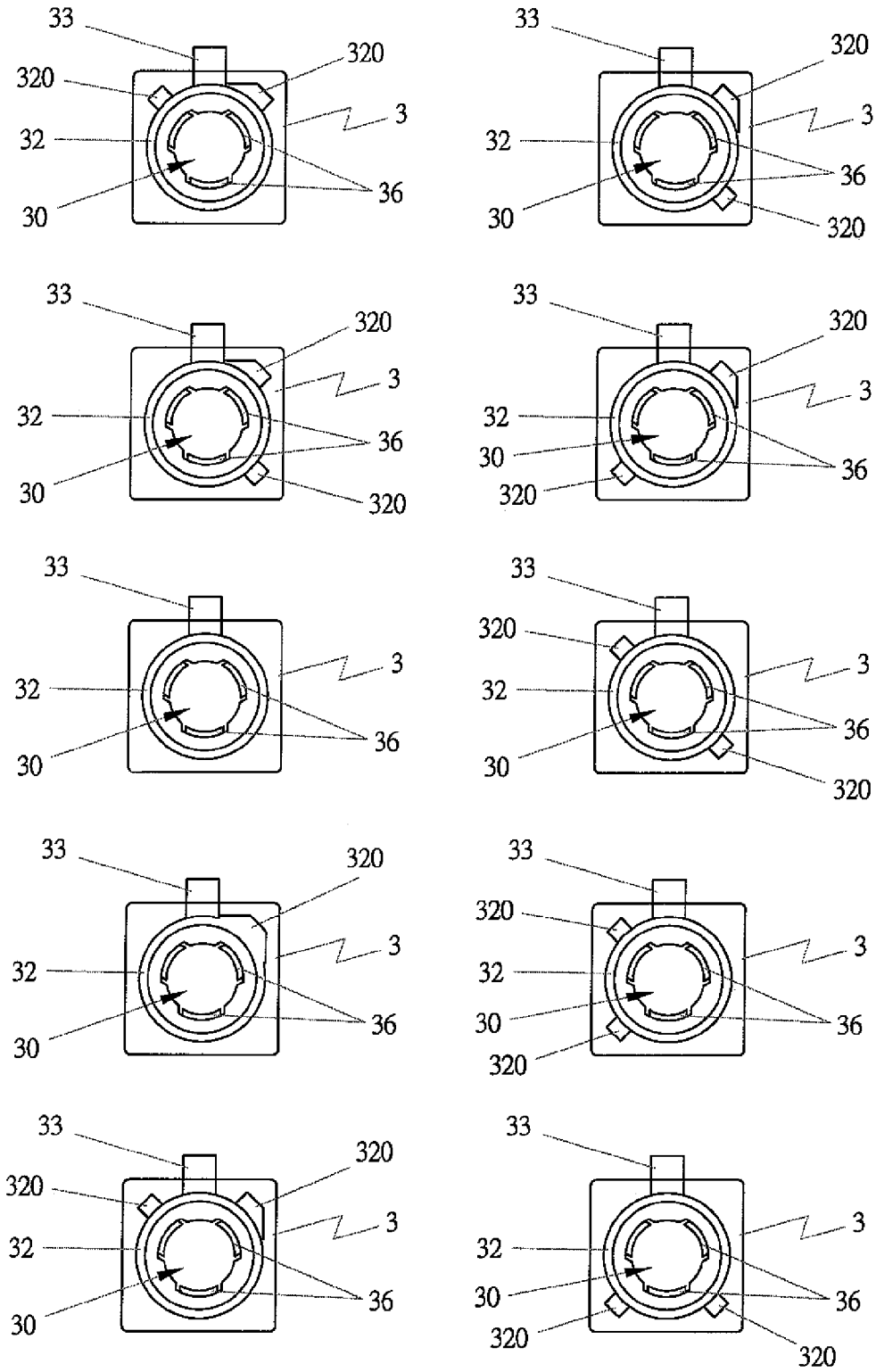
FIG. 8 is front views of the male connectors with different specifications in the present invention.

The F.S. male connector 3 is formed with the terminal-base hole 30 for receiving a part of the terminal base 2 therein. The terminal-base hole 30 has its front circumference 31 formed with a comparatively large inner diameter for facilitating connecting another connector. The F.S. male connector 3 further has its outer circumferential wall 32 fixed with one or more sets of lengthwise correction projections 320, as shown in FIG. 4, so that when two connectors are connected, their polarity can be correct without fail. The positions of the correction projections 320 are based on practical needs and the specifications of the F.S. male connector 3, and the shapes and structure of different-specification of male connectors available for the present are shown in FIG. 8. Further, the F.S. male connector 3 has its outer circumferential wall 32 secured with an engage member 33 so that when two connectors are connected, it can be tightly fitted with the engage member 33, unable to be separated from each other without external force. Furthermore, the terminal-base hole 30 of the F.S. male connector 3 is formed with the small-diametric annular circumference 34 and the medium-diametric annular circumference 35 respectively matching with the corresponding portions of a terminal. The medium-diametric annular circumference 35 is fitted integrally with a plurality of elastic petals 36 formed with slanting surfaces 360, annular surfaces 361 and vertical fitting surfaces 362. The slanting surfaces 360 of the elastic petals 36 enable a terminal to be quickly inserted in the terminal-base hole 30 of the F.S. male connector 3, while the vertical fitting surfaces 362 of the elastic petals 36 are able to firmly hold the terminal to prevent it from slipping off, enabling the terminal base 2 to be completely combined with the terminal-base hole 30 of the F.S. male connector 3 and firmly fixed in position.

Figure 1:
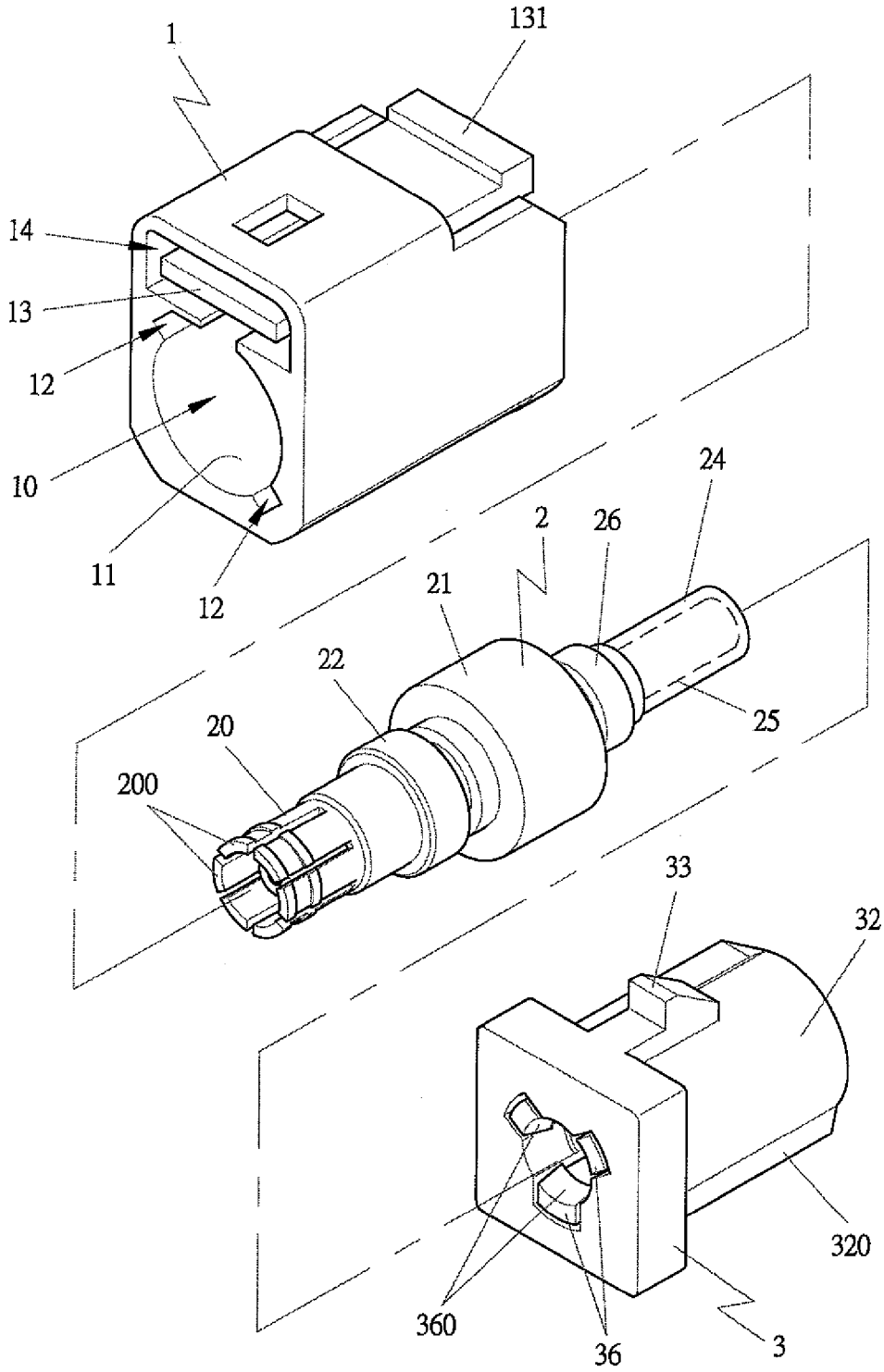
FIG. 1 is an exploded perspective view of a first preferred embodiment of a cable adaptor in the present invention.
Figure 2:
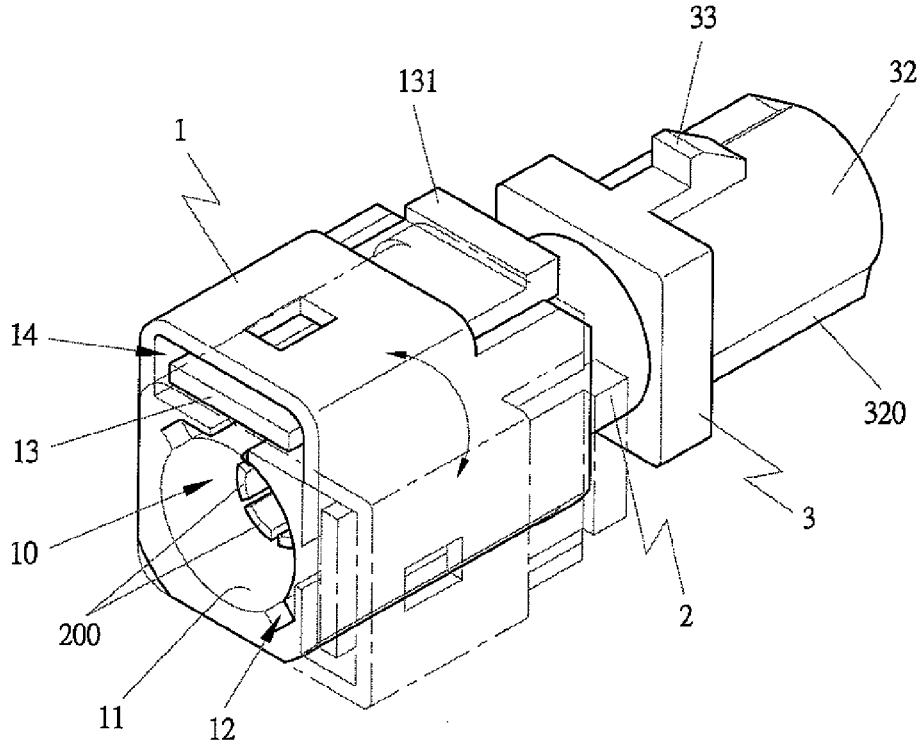
FIG. 2 is a perspective view of the first preferred embodiment of the cable adaptor in an operating condition in the present invention.

Thus, a terminal base 2 provided with the female terminal 20 at one end and the male terminal 24 at the other end can be combined respectively with the F.S. female connector 1 and the F.S. male connector 3 to make up a cable adaptor with the F.S. female connector 1 at one end and the F. S. male connector 3 at the other end, as shown in FIG. 2, Or a terminal base 2 having both ends respectively provided with the female terminal 20 can be combined with two F.S. female connectors 1 to form a cable adaptor with the F.S. female connector 1 respectively at the opposite ends, as shown in FIGS. 9 and 1, Or a terminal base 2 having its opposite ends both provided with the F.S. male terminal 24 can be combined with two male connectors 3 to make up a cable connector with two F.S. male connector 3 respectively at the opposite ends, as shown in FIGS. 10 and 12. Further, the F.S. male and the female connector, or two F.S. male connectors or two F. S. female connectors respectively positioned at the opposite ends of the cable adaptor can be arranged in alignment, as shown in FIGS. 6-9, or disposed at a proper angle, such 90 degrees or 135 degrees or the like in accordance with practical needs, as shown in FIGS. 11-13. By so designing, the cable adaptor is simple in structure, convenient in use and able to connect exterior signal connectors with perfection. Furthermore, the male and the F.S. female connector 3, 1 of the cable adaptor can be turned for an angle for conveniently connecting an exterior connector according to practical needs, as shown in FIG. 2.

Other preferred embodiments of a cable adaptor in the present invention, as shown in FIGS. 14-17, includes a F.S. female connector 1 and an S. female conductor or an S. male conductor and a terminal base 2 combined together.

The F.S. female connector 1 in these embodiment has the same structure as that in the first embodiment, which is provided with a terminal-base hole 10 with correction notches 12, an engage member 13, an engage member groove 14, and a connecting rib 130 and a press member 131 disposed on the engage member 13. When the press member 131 at the rear end of the engage member 13 is pressed downward, the front end of the engage member 13 will be moved upward for facilitating an exterior connector to be inserted in and pulled out of the terminal base hole 10 of the female connector 1. The terminal-base hole 10 of the F.S. female connector 1 has its rear end formed with a plurality of elastic petals 15 spaced apart so that the terminal base 2 can be conveniently and firmly positioned in the terminal base hole 10 of the female connector 1. The petals 15 have their inner wall formed with slanting surfaces 150, vertical fitting surfaces 151 and annular surfaces 152 for matching with the shapes of the terminal base 2. Further, the female connector 1 can be turned for any angle for facilitating connecting an exterior connector, as shown in FIG. 2.

Figure 14:
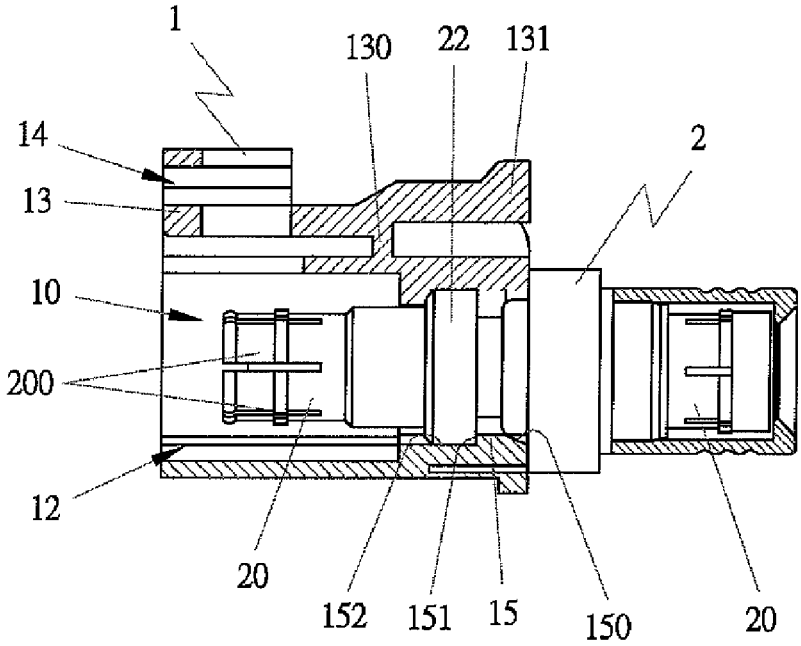
FIG. 14 is a side cross-sectional view of a seventh preferred embodiment of a cable adaptor in the present invention.
Figure 15:
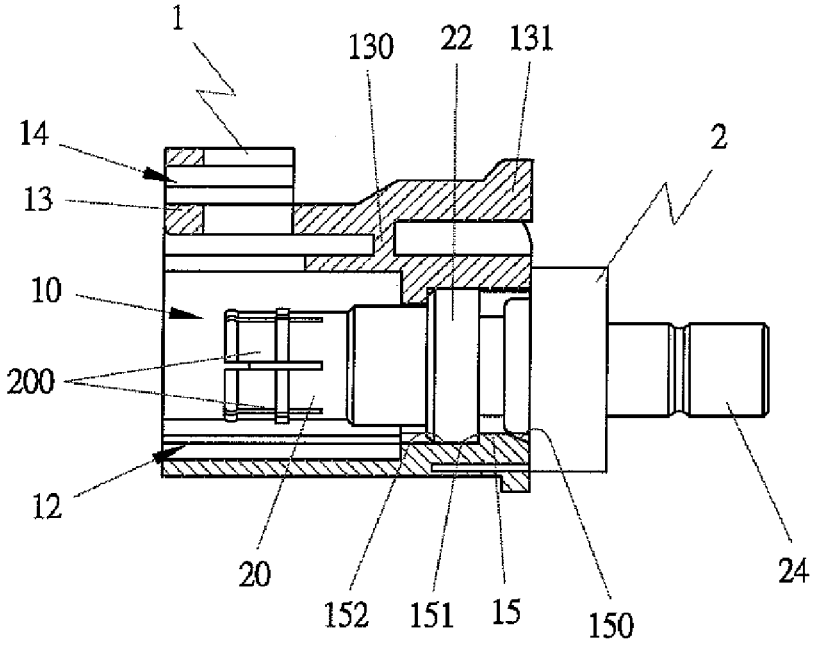
FIG. 15 is a side cross-sectional view of an eighth preferred embodiment of a cable adaptor in the present invention.
Figure 16:
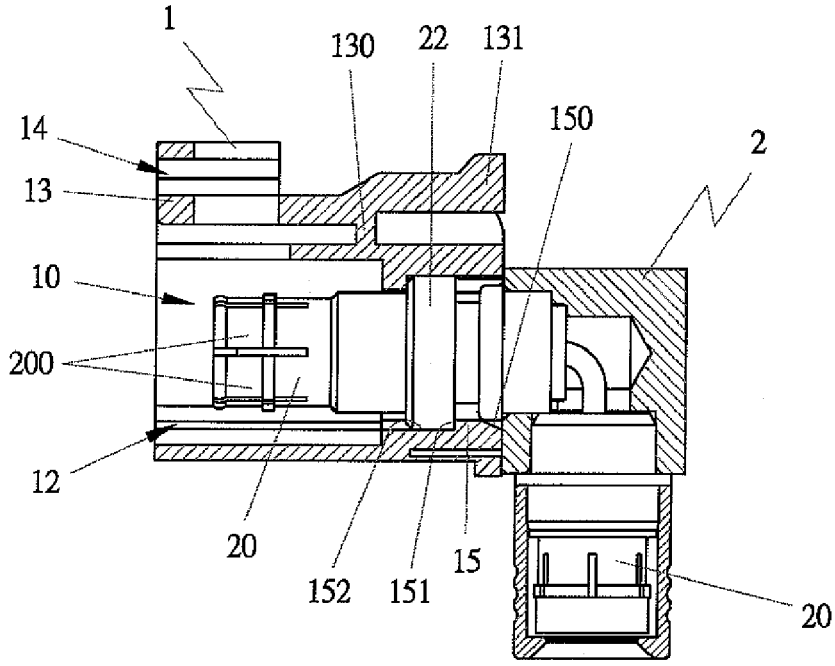
FIG. 16 is a side cross-sectional view of a ninth preferred embodiment of a cable adaptor in the present invention.

The terminal base 2 has its opposite ends respectively provided with a female terminal 20 and a male terminal 24, as shown in FIGS. 6, 11 and 15, or both provided with a female terminal 20, as shown in FIGS. 9, 14 and 16. The two terminals at the opposite ends of the terminal base 2 can be positioned in alignment, as shown in FIGS. 14 and 15, or disposed at a proper angle, such as 90 degrees or 135 degrees or the like according to practical needs, as shown in FIGS.

Figure 17:
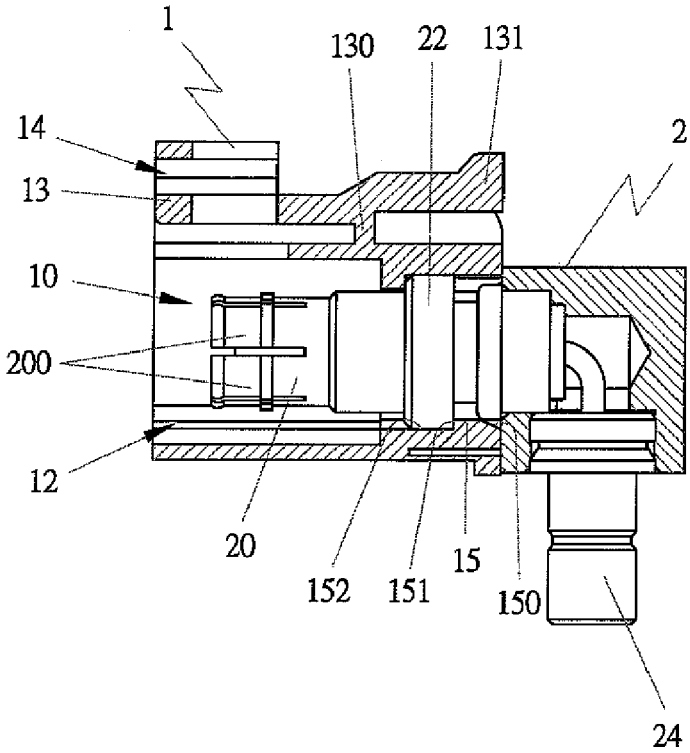
FIG. 17 is a side cross-sectional view of a tenth preferred embodiment of a cable adaptor in the present invention.

16 and 17. The structure of the terminal base 2 of these preferred embodiments is the same as that described in the previous preferred embodiments. Further, the cable adaptor in these preferred embodiments has one end provided with an SMB female conductor 20, as shown in FIGS. 14 and 16, or provided with an SMB male conductor 24, as shown in FIGS. 15 and 17, to make up a cable adaptor having one end fitted with a FAKRA SMB female connector and the other end directly formed with a S. female conductor 20 or an S. male conductor 24.

Next, other preferred embodiments of a cable adaptor in the present invention, as shown in FIGS. 18-21, includes a F.S. male connector 3 and an S. female or male conductor 20 or 24 combined together.

The F.S. male connector 3 in these embodiments has a same structure as that in the first embodiment that is provided with a terminal base hole 30 with a front circumference 31, an outer circumferential wall 32 fixed with correction projections 320, as shown in FIG. 4 of the first preferred embodiment, so that when two connectors are connected, their polarity can be correct by means of the correction projections 320. The positions of the correction projections 320 can be changed in accordance with practical needs and the specifications of the F.S. male connectors 3, and the shapes and structure of different-specification male connectors available for the present are shown in FIG. 8. Further, the F.S. male connector 3 has its outer circumferential wall 32 disposed with an engage member 33 so that when two connectors are connected, they can be tightly engaged with each other by the engage member 33 and unable to be separated from each other without external force. Furthermore, the terminal base hole 30 of the male connector 3 has its interior formed with a small-diametric annular ring 34 and a medium-diametric annular ring 35 respectively matching with the corresponding portions of the terminal. The medium-diametric annular circumference 35 is formed integrally with a plurality of elastic petals 36 with slanting surfaces 360, annular surfaces 361 and vertical engage surfaces 362. The slanting surfaces 360 enable the terminal to be quickly inserted in the terminal base hole 30, while the vertical engage surfaces 362 are able to fixedly hold the terminal and prevent it from slipping off, letting the terminal base 2 firmly positioned in the terminal base hole 30. Moreover, the F.S. male connector 3 can be turned for any angle for facilitating connecting an exterior connector, as shown in FIG. 2.

Figure 18:
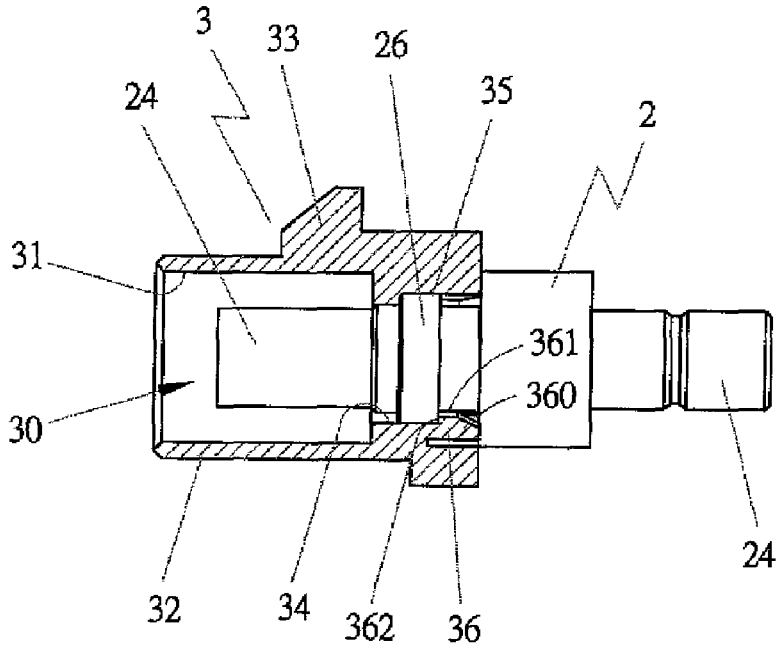
FIG. 18 is a side cross-sectional view of an eleventh preferred embodiment of a cable adaptor in the present invention.
Figure 19:
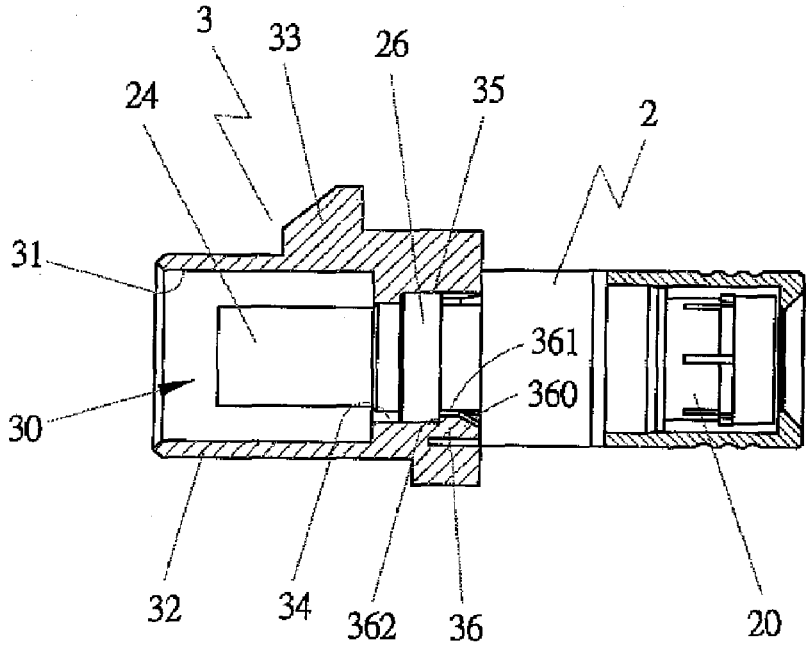
FIG. 19 is a side cross-sectional view of a twelfth preferred embodiment of a cable adaptor in the present invention.
Figure 20:
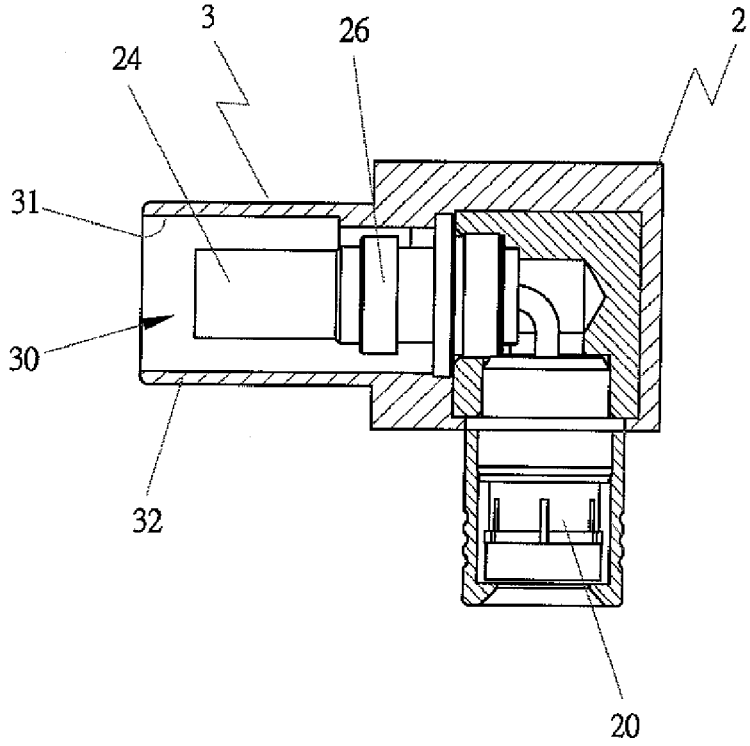
FIG. 20 is a side cross-sectional view of a thirteenth preferred embodiment of a cable adaptor in the present invention.
Figure 21:
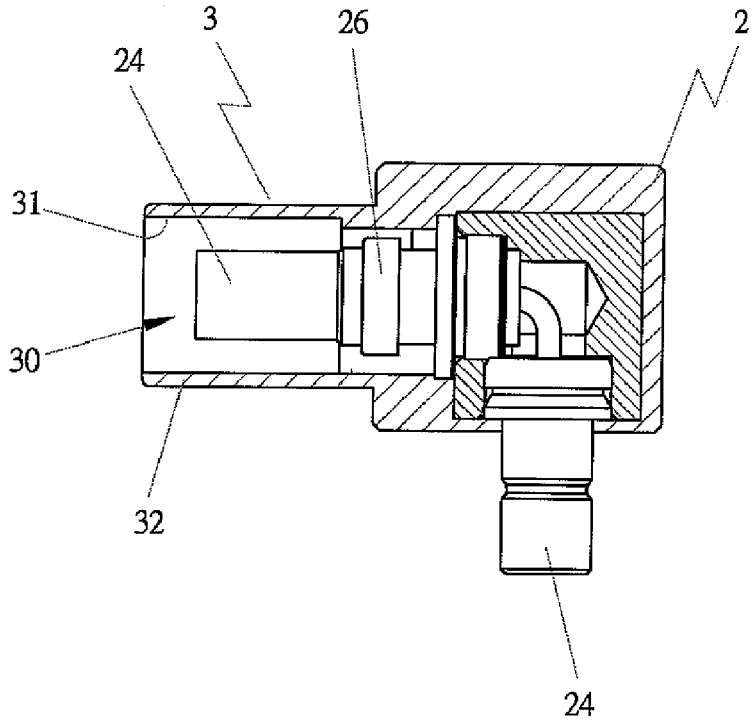
FIG. 21 is a side cross-sectional view of a fourteenth preferred embodiment of a cable adaptor in the present invention.

The terminal base 2 has its opposite ends respectively provided with a female terminal 20 and a male terminal 24, as shown in FIGS. 6, 11, 19 and 20, or both provided with a male terminal 24, as shown in FIGS. 10, 18 and 21. The two terminals at the opposite ends of the terminal base 2 can be arranged in alignment, as shown in FIGS. 18 and 19, or disposed at a proper angle, such as 90 degrees or 135 degrees or the like according to practical needs, as shown in FIGS. 20 and 21. The structure of the terminal base 2 of these preferred embodiments has the same structure as that in the first preferred embodiment. The cable adaptor of these preferred embodiments have one end provided with a FAKRA SMB male connector 3 and the other end directly formed with an S. female conductor 20, as shown in FIGS. 19 and 20, or provided with an S. male terminal 24, as shown in FIGS. 18 and 21.

Thus, the F. S. female connector 1 or the F.S. male connector 3 can independently be combined with the terminal base 2, and the terminal base 2 has one end directly formed with an S, female terminal 20 or an S. male terminal 24 to make up a cable adaptor applicable to connection of various exterior connectors.

While the preferred embodiments of the invention have been described above, it will be recognized and understood that various modifications may be made therein and the appended claims are intended to cover all such modifications that may fall within the spirit and scope of the invention.

I claim:

1. A cable adaptor comprising:

a female connector formed with a terminal base hole for receiving a terminal base therein, said terminal-base hole having its front circumferential edge bored with correction notches, said female connector provided with an engage member positioned in an engage member groove, said engage member groove extending backward to be combined with said female connector, said engage member having its rear side formed with a connecting rib and a press member, said terminal-base hole having its rear end disposed with a plurality of elastic petals spaced apart for facilitating combination of said terminal base with said terminal base hole;

the terminal base having its opposite ends respectively provided with a terminal; and a male connector formed integral and provided with a terminal hole for receiving a terminal therein, said terminal hole having its front circumference formed with a comparatively large inner diameter, said male connector having its outer circumferential wall provided with correction projections for facilitating connecting a male or a female connector, said male connector further having its outer circumferential wall disposed with an engage member, said terminal hole of said male connector having its interior formed with a small-diametric annular circumference and a medium-diametric annular circumference, said medium-diametric annular circumference provided with a plurality of elastic petals, said elastic petals formed with slanting surfaces, annular surfaces and vertical engage surfaces.

2. The cable adaptor as claimed in claim 1, wherein said two terminals of said terminal base are positioned at an angle of 90 degrees.

3. The cable adaptor as claimed in claim 1, wherein said two terminals of said terminal base are disposed at an angle of 135 degrees.

4. The cable adaptor as claimed in claim 1, wherein said two terminals of said terminal base are respectively a female terminal and a male terminal.

5. The cable adaptor as claimed in claim 1, wherein said male connector or said female connector can be turned for any angle.

6. The cable adaptor as claimed in claim 1, wherein said two terminals of said terminal base are positioned in alignment.

7. A cable adaptor comprising:

a female connector formed with a terminal-base hole, said terminal-base hole having its front circumference cut with correction notches, said female connector provided with an engage member received in an engage member groove, said engage member groove extending backward to be combined with said female connector, said engage member having its rear side formed with a connecting rib and a press member, said terminal base hole having its rear end formed integrally with a plurality of elastic petals for facilitating combination of said terminal base with said terminal-base hole, said female connector having one end provided with a circular terminal base, said terminal base fixed with a female terminal; and a terminal base having its opposite ends respectively provided with a terminal, one of said two terminals of said terminal base being connected to said female connector.

8. The cable adaptor as claimed in claim 7, further comprising another female connector for connecting the another one of said two terminals of said terminal base, said female connector formed with a terminal-base hole for receiving a terminal base therein, said terminal-base hole having its front circumference bored with correction notches, said female connector provided with an engage member received in an engage member groove, said engage member groove extending backward to be combined with said female connector, said engage member having its rear end formed with a connecting rib and a press member, said terminal-base hole having its rear end disposed with a plurality of plastic petals for facilitating combination of said terminal base with said terminal-base hole.

9. The cable adaptor as claimed in claim 7, wherein said two terminals of said terminal base are disposed at an angle of 135 degrees.

10. The cable adaptor as claimed in claim 7, wherein said two terminals of said terminal base are respectively a female terminal and a male terminal.

11. The cable adaptor as claimed in claim 7, wherein said two terminals of said terminal base are female terminals.

12. The cable adaptor as claimed in claim 7, wherein said two terminals of said terminal base are positioned in alignment.

* * * * *